US010400447B2

(12) United States Patent
Sims et al.

(10) Patent No.: US 10,400,447 B2
(45) **Date of Patent: *Sep. 3, 2019**

(54) COVERING SUPPORT SYSTEM

(71) Applicant: Southern Wall Systems, Inc., Suwanee, GA (US)

(72) Inventors: Benny R. Sims, Suwanee, GA (US); Richard Barnes, Suwanee, GA (US)

(73) Assignee: Southern Wall Systems, Inc., Suwanee, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/888,564

(22) Filed: Feb. 5, 2018

(65) Prior Publication Data

US 2018/0155925 A1 Jun. 7, 2018
US 2019/0024371 A9 Jan. 24, 2019

Related U.S. Application Data

(63) Continuation of application No. 15/228,714, filed on Aug. 4, 2016, now Pat. No. 9,885,178.

(51) Int. Cl.

| | |
|---|---|
| ***E04H 1/00*** | (2006.01) |
| ***E04B 2/56*** | (2006.01) |
| ***E04B 5/02*** | (2006.01) |
| ***E04C 3/02*** | (2006.01) |
| ***E04F 13/08*** | (2006.01) |

(52) U.S. Cl.
CPC ..... *E04B 2/56* (2013.01); *E04B 5/02* (2013.01); *E04C 3/02* (2013.01); *E04F 13/0803* (2013.01)

(58) Field of Classification Search
CPC ..... E04B 2/56; E04B 5/02; E04F 13/0803; E04C 3/02
USPC ..... 52/236.7
See application file for complete search history.

(56) References Cited

U.S. PATENT DOCUMENTS

| | | | | |
|---|---|---|---|---|
| 2,037,560 | A | 4/1936 | Bettinger | |
| 3,487,598 | A | 1/1970 | Lopina | |
| 4,070,803 | A | 1/1978 | Gartung | |
| 5,412,920 | A * | 5/1995 | Hess | E04B 5/12 403/232.1 |
| 5,653,079 | A * | 8/1997 | Loeffler | E04B 1/2608 403/396 |
| 6,151,843 | A | 11/2000 | Weaver | |
| 6,230,466 | B1 * | 5/2001 | Pryor | E04B 1/2612 403/231 |
| 6,430,890 | B1 | 8/2002 | Chiwhane | |
| 6,446,409 | B1 | 9/2002 | Emerson | |
| 6,655,096 | B1 * | 12/2003 | Pryor | E04B 7/045 52/712 |
| 7,310,914 | B1 | 12/2007 | Moore | |
| 8,281,552 | B2 | 10/2012 | Pilz | |
| 8,316,599 | B2 | 11/2012 | Griffiths | |
| 8,429,866 | B2 | 4/2013 | Knight | |
| 8,484,927 | B2 | 7/2013 | Nguyen | |

(Continued)

*Primary Examiner* — Basil S Katcheves
(74) *Attorney, Agent, or Firm* — Fish & Richardson P.C.

(57) ABSTRACT

A covering support system includes a covering support that has a support member defining a support surface and that is connected to a mounting member so that when the mounting member is rigidly mounted relative to a wall stud, the support surface is substantially flush with an exterior surface of the wall stud and disposed from the exterior of a building surface by the overhang distance.

5 Claims, 6 Drawing Sheets

(56) References Cited

U.S. PATENT DOCUMENTS

| | | | | |
|---|---|---|---|---|
| 8,555,566 | B2 * | 10/2013 | Pilz | E04B 2/828 52/167.1 |
| 8,667,765 | B1 | 3/2014 | McCarthy | |
| 9,003,738 | B1 | 4/2015 | Evans, Jr. | |
| 2003/0041538 | A1 | 3/2003 | Ting | |
| 2004/0010998 | A1 | 1/2004 | Turco | |
| 2004/0237443 | A1 | 12/2004 | Haley | |
| 2007/0151190 | A1 | 7/2007 | Huff | |
| 2013/0247499 | A1 | 9/2013 | Zimmerman | |

* cited by examiner

COVERING SUPPORT SYSTEM

CROSS-REFERENCE TO RELATED APPLICATIONS

This application is a continuation application of, and claims priority to, U.S. patent application Ser. No. 15/228,714, now U.S. Pat. No. 9,885,178, titled "COVERING SUPPORT SYSTEM," filed on Aug. 4, 2016. The disclosure of the foregoing application is incorporated herein by reference in its entirety for all purposes.

BACKGROUND

A common practice in the construction industry is the application of covering, e.g., cladding, panels, siding, sheathing, on exterior walls of buildings. Typically, the covering is attached to studs defining a frame of an outside wall. The studs may be load bearing or non-load bearing. For multi-story buildings, especially commercial buildings, the building studs may not extend over the exterior surface of the floor/ceiling slab between each floor. Therefore, the covering may overhang the exterior surface of the slab but is not attached to the slab. Because the covering is typically not reinforced and instead is designed with expectation that it will receive much of its structural support from the frame to which it is to be attached, the section of covering that overhangs the exterior slab surface is much more susceptible to damage than the sections of covering that are attached to the studs. Pressure on the overhanging portion of the panel, such as that caused by impacts to the panel during building construction, or by strong winds, may cause the panel to bend or fracture.

One solution is to build an exterior frame in which non-load bearing studs extend across the exterior surface of the slab. While this provides ample support for the covering, the building of the exterior frame adds additional square footage to the exterior footprint of the building, and is also more expensive than building a frame structure between each floor that spans from only the floor surface to the ceiling surface.

SUMMARY

This specification describes technologies relating to a covering support system that provides structural support for a covering that overhangs an exterior surface of floor slab or column. The covering support system can be used with a covering support frame that can be separately constructed for each floor. In the examples described below, the covering support system is described in the context of panels or sheathing as the covering. However, other coverings, such as siding, cladding, skins, etc., may also be supported by the covering support system.

In an aspect, the covering mounting system includes a covering support comprising: a mounting member configured to be rigidly mounted to one or more of a wall stud or stud track that overhangs an exterior building surface by an overhang distance; a support member defining a support surface and that is connected to the mounting member so that when the mounting member is rigidly mounted relative to the wall stud the support surface is substantially flush with an exterior surface of the wall stud and disposed from the exterior building surface by the overhang distance; and a bracing component connected to the support member and that provides rigid support to the support member to reduce flexion of the support member and thereby maintain the disposition of the support surface from the exterior building surface by the overhang space.

In an aspect, the covering mounting system includes a covering support comprising: means for rigidly mounting the covering support to one or more of a wall stud or stud track that overhangs an exterior building surface by an overhang distance; means for defining a support surface and that is connected to means for rigidly mounting so that when the means for rigidly mounting is rigidly mounted relative to the wall stud the means for defining a support surface is substantially flush with an exterior surface of the wall stud and disposed from the exterior building surface by the overhang distance; and means for bracing connected to the means for defining a support surface and for providing rigid support to means for defining a support surface to reduce flexion of the means for defining a support surface and thereby maintain the disposition of the means for defining a support surface from the exterior building surface by the overhang space.

The systems and features described in this document can be used to realize one or more of the following advantages. Cost savings are achieved by obviating the need to build an exterior frame structure that spans exterior slabs and columns. The cost savings are due in part to the reduced complexity of the frame structure that is built between floors, which reduces time and material requirements. Additional cost savings are achieved by maximizing the usable space of a building footprint, as the usable space is not reduced by the space required for an exterior framing structure.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements. Furthermore, in several drawings element numbers are be omitted to avoid congestion in the drawings.

DETAILED DESCRIPTION

Figure 1:
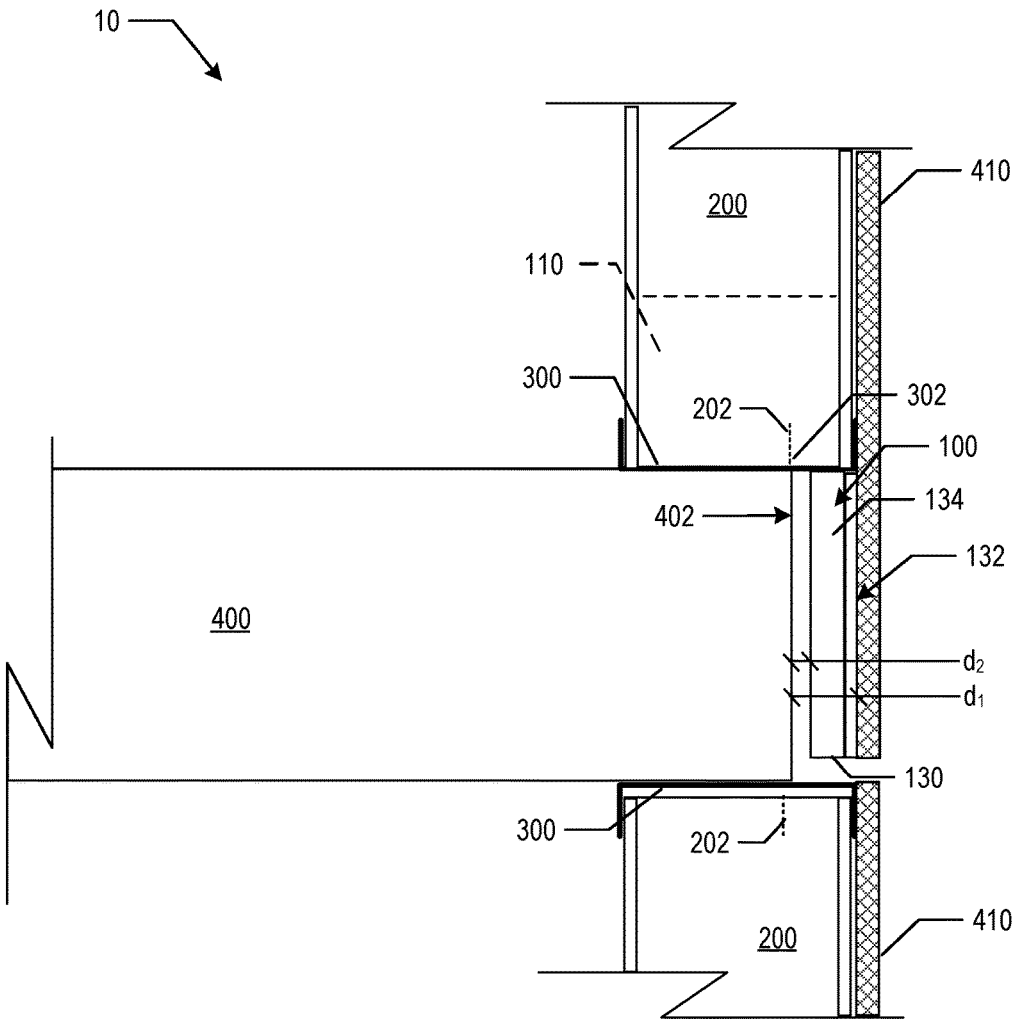
FIG. 1 is a cross-sectional side view of a covering support system.

FIG. 1 is a cross-sectional side view of a covering support system 10. In the examples described below, the covering support system 10 is described in the context of a panel support system that supports panels. However, other coverings, such as cladding, skins, siding, etc. may also be supported by the covering support system. Accordingly, applications of the system 10 are not limited to panels.

The covering support system 10 includes a panel support 100 that, when rigidly mounted to one or both of a wall stud 200 or stud track 300, provides a support surface 132 that provides support for sheathing 410. The support surface 132 is preferably flush with an exterior surface of the wall stud 200, as will be described in more detail below. The support surface 132 is an outer surface of a support member 130 and is disposed from an exterior slab surface 402 of a slab 400 by an overhang distance $d_1$. The support member 130 may optionally be dimensioned so that it is spaced apart from the surface by a distance $d_2$. A bracing component 134 is connected to the support member 130 and provides rigid support to the support member 130 to reduce flexion of the support member 130, which helps maintain the disposition of the support surface from the exterior slab surface 402.

The panel support 100 includes a mounting member that attaches to one or both of the wall stud 200 or stud track 300. The mounting member may take several forms, and the example shown in FIG. 1 is a flange 110. The flange 110 and other forms of the mounting member are described in more detail below.

The wall stud 200 is one of multiple wall studs that are received in the stud track 300. As shown in FIG. 1, the stud track 300 may be a conventional stud track that is of a width that completely receives the wall stud and overhangs the slab 400 by the overhand distance $d_1$. However, when the flange 110 is used for the mounting member of the panel support 100, at least the top stud track 300 may be of a width that is less than the wall stud track 300. In this implementation, one vertical end of the stud track 300, formed by a flange 302, may be received in a slot 202 in the wall stud 200.

Various implementation of the support system 100 will be described in more detail with reference to FIGS. 2A-5B. In particular, a first implementation is described with reference to FIGS. 2A-2D, which depict cross-sectional and perspective views of the first example implementation of the panel support system 100.

In the implementation of FIGS. 2A-2D, the panel support 100 has a support member 130 that includes an exterior surface 132 upon which sheathing 410 may be mounted. Any conventional mounting fixture or adherent may be used to mount the sheathing 410 to the exterior surface 132.

The support member 130 is further braced by a flange 134 that forms a bracing component. In some implementation, the thickness of the support member 130 and the span over which the member 130 is to be provide support may obviate the need for a separate support. In these implementations, a separate bracing component is not required for the support member 130.

Another flange, flange 110, is used as a mounting member. The flange 110 includes a second flange 112 that extends substantially perpendicularly from the flange 110. The support surface 132 and the surface of the flange 112 are approximately spaced apart by a distance $W_s$, which is approximately equal to the interior width of the stud 200 of FIG. 2B.

Figure 2A:
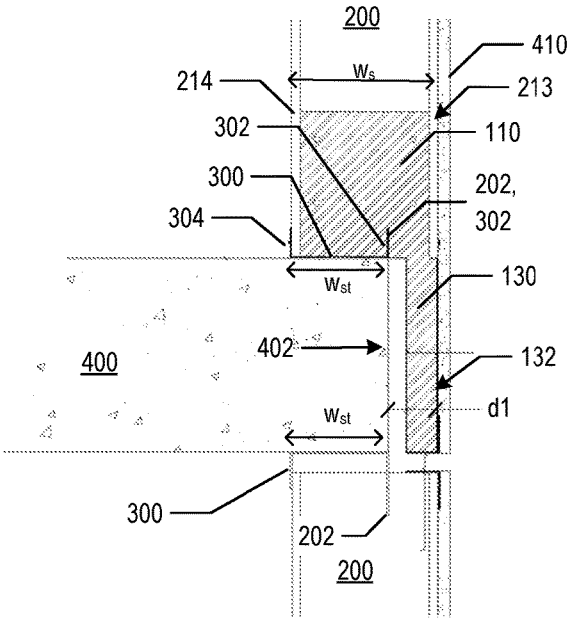
FIGS. 2A-2D are cross-sectional and perspective views of one example implementation of the panel support system.
Figure 2B:
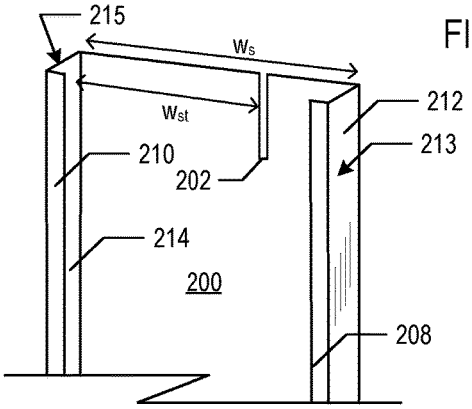
Figure 2C:
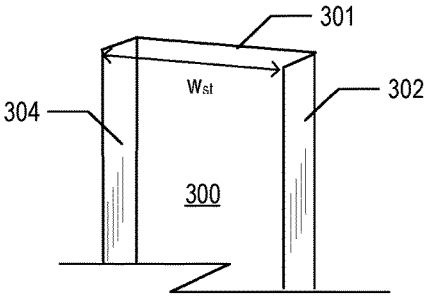
Figure 2D:
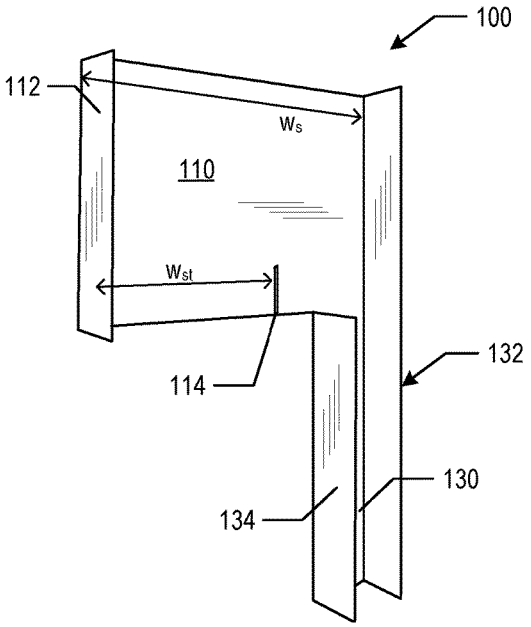

The stud 200 of FIG. 2B includes a first stud member 212 defining a first stud surface 213. The first stud member 212 may also have a flange fold 208 that forms a surface substantially parallel to body surface of the stud 200. Likewise, the stud 200 includes a second stud member 214 defining a second surface 215 opposite the first stud surface 213, and also includes a similar fold 210, thus forming a slot into which the panel support 100 may be received. When the stud 200 receives the panel support 100, as shown, for example, in the cross-section view of FIG. 2A (note the upper stud 200 in FIG. 2A is a mirrored configuration of the stud 200 of FIG. 2B), the flange 112 and the flange forming the support surface 132 are received in slots formed by the stud members 212 and 214 and folds 208 and 210. After insertion, the flange 110 may be rigidly attached to the stud 200 by fasteners, adherents, welds, or other rigid attachment means.

The stud track 300 includes a base 301, a first vertical flange 302 extending upward from a first side of the base 301 and running substantially a length of the first stud track 300, and a second vertical flange 304 extending upward from a second side of the base 301 that is opposite the first side of the base 301 and also running substantially the length of the first stud track 200. The width $W_{st}$ of the first stud track is less than a width $W_s$ of a stud that is designed to be received within the first stud track 300. Accordingly, the first stud includes a slot 202 that receives one of the flanges of the stud track 300, e.g., flange 302. The difference between the width of the stud track 300 and the width of the stud 200 is approximately the overhang distance $d_1$. When the slot 202 in the side surface of the stud 200 receives the flange 302, the second stud member 214 abuts the second vertical flange 304 of the first stud track 300.

Likewise, the flange 110 in the panel support 100 also includes a slot 114 that is operatively aligned with the slot 202 and the flange 302 so that it, too, receives the flange 302 of the stud track 300 when the panel support 100 is inserted into the stud 200 and the stud, in turn, is received in the stud track 300.

When so assembled as shown in FIG. 2A, the support surface 132 of the panel support 100 is substantially flush with the exterior surface (e.g., surface 213) of the stud 200. Accordingly, when each stud 200 in a sheathing support wall is affixed with a respective panel support 100, the panel supports 100 provide support surfaces 132 that overhang the exterior surface 402 of the slab 400. This allows for a structurally sound mounting frame upon which panels, such as sheathing 410, may be attached to the exterior of a building.

Figure 3A:
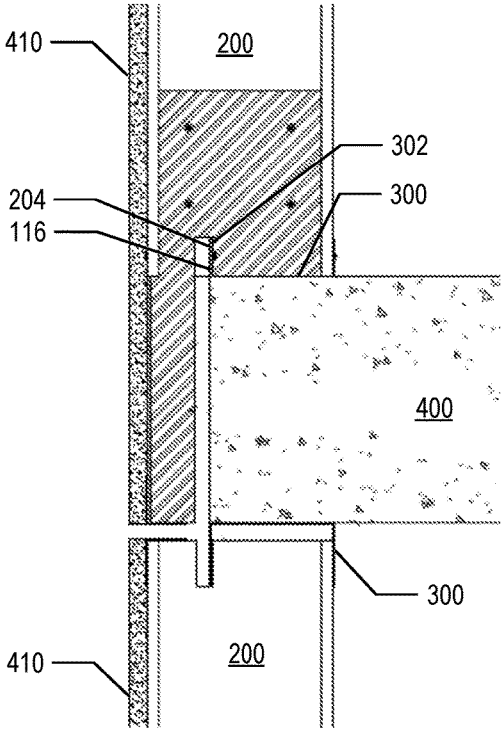
FIGS. 3A-3C are cross-sectional and perspective views of another example implementation of the panel support system.
Figure 3B:
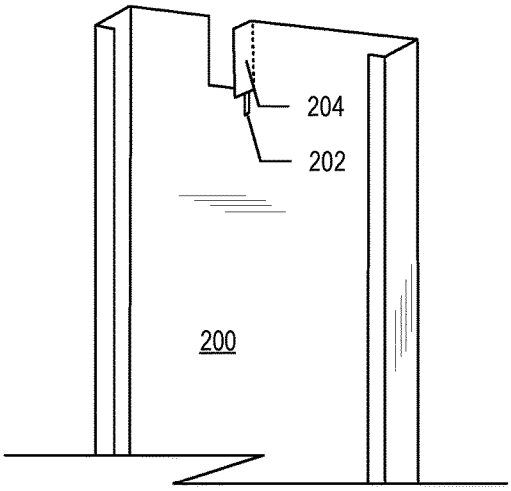
Figure 3C:
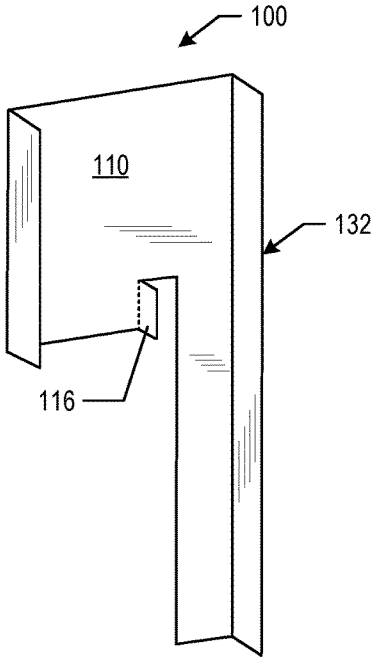

In another implementation, respective mating flanges are provided on the stud 200 and the panel support 100 for additional structural support. One example implementation is shown in FIGS. 3A-3C. As show in 3B, a mating flange 204 is formed in the stud 200 by a cut and fold of a portion of the frame of the stud 200. The slot 202 may optionally extend above the mating flange 204. A reciprocal mating flange 116 is likewise formed in the plane support 100.

When the panel support 100, stud 200 and stud track 300 are assembled in a manner similar to the assembly described with reference to FIG. 2A, and as shown in FIG. 3A, the mating flanges 116 and 204 overlap and can be connected by fasteners, welds, etc. Furthermore, as illustrated in FIG. 3A, the mating flanges 116 and 204 may also be proximate to the flange 302 of the stud track 300 such that they can be attached to the flange 302 of the stud track for additional structural support.

Although a mating flange is shown on both the stud 200 and the panel support 100, in some implementations only the panel support includes the mating flange.

Figure 4A:
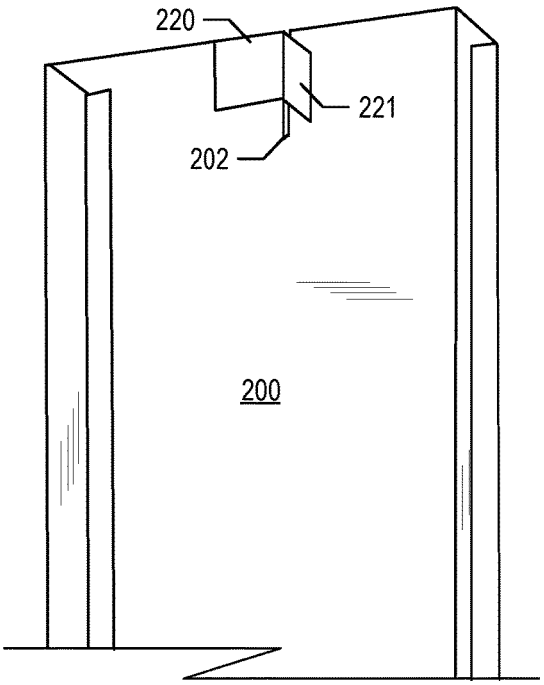
FIGS. 4A and 4B are perspective views of another example implementation of the panel support system.
Figure 4B:
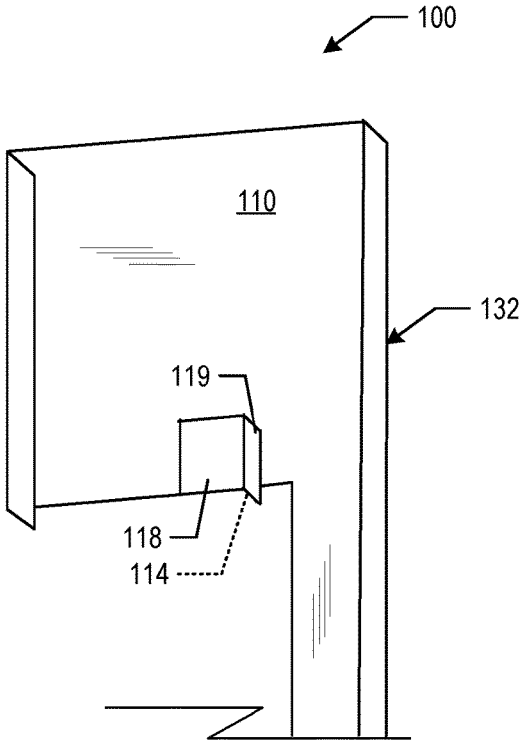

FIGS. 4A and 4B are perspective views of another example implementation of the panel support system. The mating flanges 221 and 119 are formed by perpendicular metal structures having respective bases 220 and 118 and that are respectively attached to the stud 200 and the panel support 100. The flange 221 is aligned with the slot 202 in the stud 200, and the flange 119 is aligned with the slot 114 in the panel support 100. The resulting assembled configuration is similar to that of FIG. 3A, where the mating flanges 119 and 221 may be adjacent the flange 302 of the stud track 300 so that they may be attached to the flange 302 of the stud track for additional structural support.

The panel support 100 of FIGS. 2A-4B has a mounting surface 132 with a width that is approximately equal to a width of the exterior stud surface, e.g., surface 213 of the stud 200. Accordingly, a panel support 100 is typically provide for each stud. The studs, in turn, are typically spaced apart according to building code requirements.

Figure 5A:
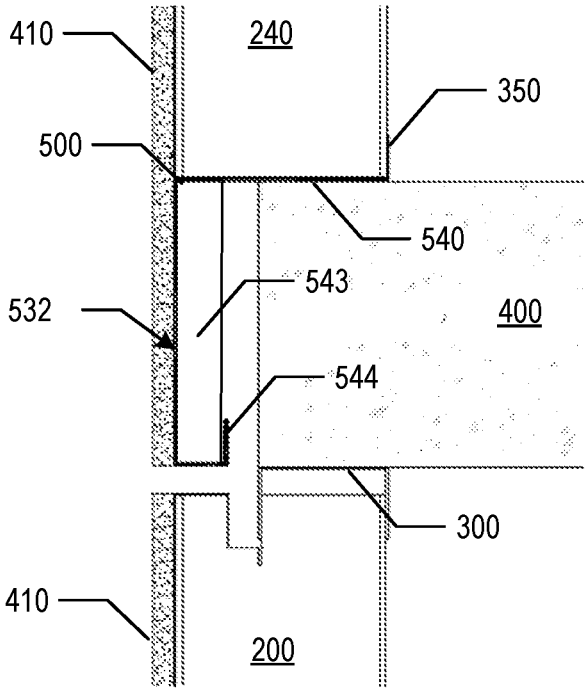
FIGS. 5A and 5B are cross-sectional and perspective views of another example implementation of the panel support system.
Figure 5B:
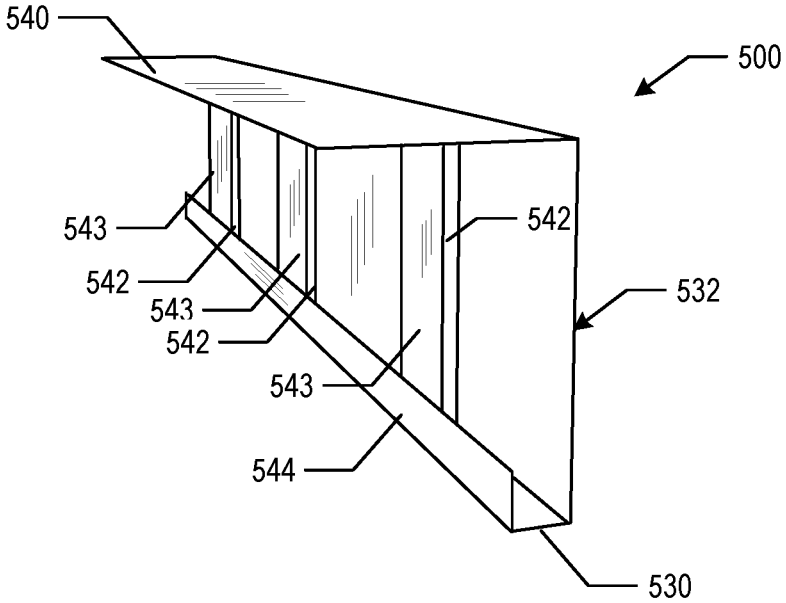

However, in another implementation, the panel support may have a continuous support surface that spans a multiple of studs that are spaced apart in the first stud track. This implementation is shown in FIGS. 5A and 5B, which are cross-sectional and perspective views of another example implementation of the panel support system. In the implementation of FIGS. 5A and 5B, the panel support 500 has a support surface 532 and a correspond flange 540 extends from the support surface 532 and serves as a mounting member. The flange 540 runs a length of the panel support 500. The support member 530 may include a fold 544 and a set of braces made from angled flanges that each have a base 542 and a perpendicular flange 543. As shown in FIG. 5A, the flange 540 may be positioned under a stud track and stud. A conventional stud 240 and stud track 350 may be used. Alternatively, the stud 200 and stud track 300 of FIGS. 2A and 2B may be used. The flange 540 may be affixed to the stud track 350 (or stud track 300, if used instead of the stud track 350) by fasteners, welds, and the like.

Figure 6:
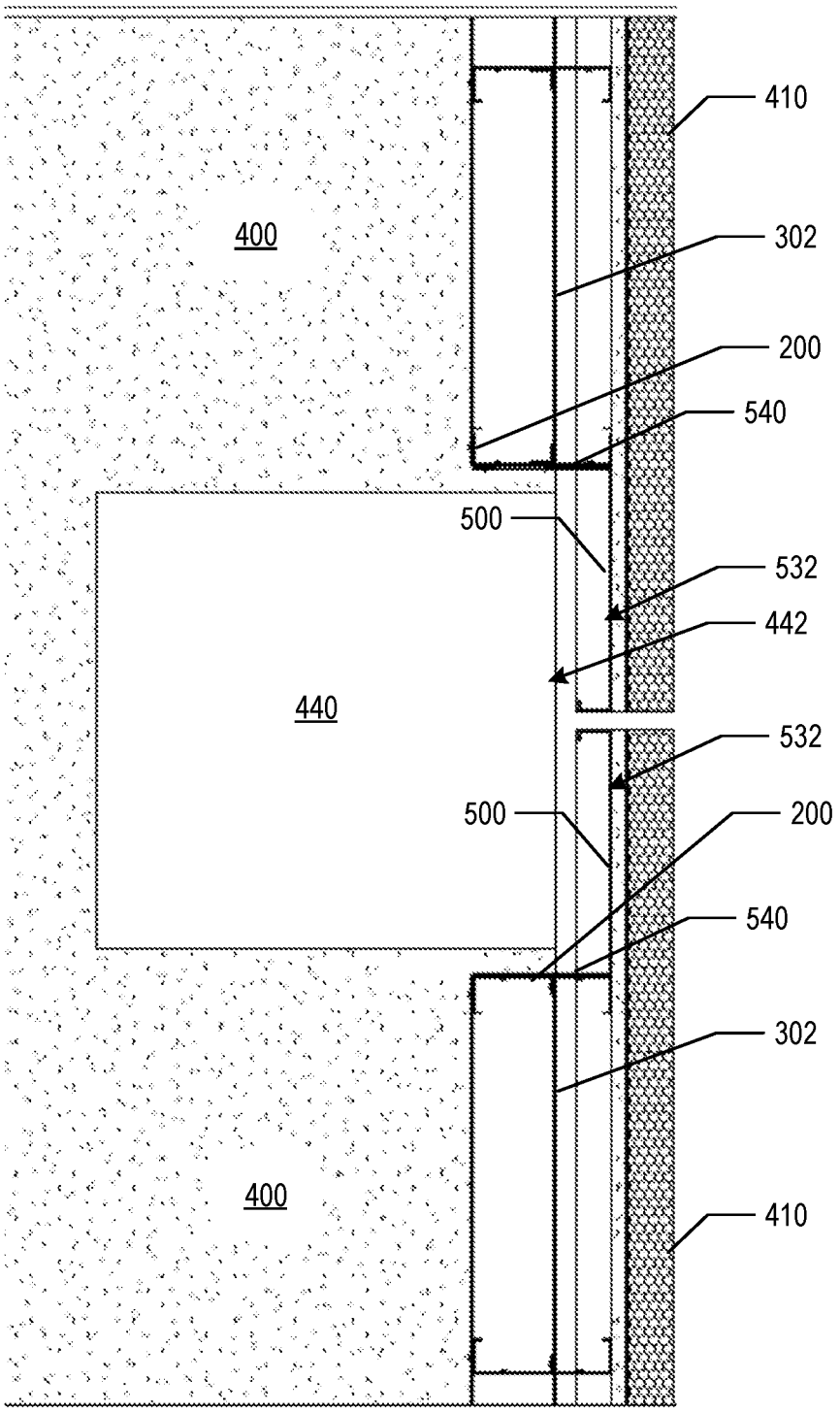
FIG. 6 is a top cross-section view of the panel support of FIG. 5B being used to provide support for sheathing over a vertical column.

The panel support 500 may also be used to provide support for other exterior building surfaces, such as a column surface. FIG. 6 is a top cross-section view of the panel support 500 of FIG. 5B being used to provide support for sheathing over a vertical column surface 442 of a vertical column 440. The portion of the slab 400 shown is the floor surface of the slab 400. Studs 200 are positioned adjacent the vertical column 400. The exterior surface of the vertical column 442 is substantially flush with the exterior surface of the slab, as indicated by the stud track flange 302. A respective panel support 500 is attached to each stud 200 in a vertical manner by connecting the flange 540 of the panel support 500 to the stud 200 along the length of the stud 200. The flange 540 may be affixed to the stud 200 by fasteners, welds, and the like.

While this specification contains many specific implementation details, these should not be construed as limitations on the scope of any features or of what may be claimed, but rather as descriptions of features specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

What is claimed is:

1. A support device, comprising:

a support member, comprising:

a support surface having a first vertical length;

a first flange that extends substantially perpendicularly from the support surface, the first flange being of a width that spans a first width equal to a distance between a first wall stud surface and a second wall stud surface of a wall stud, and being of second vertical length measured perpendicularly relative to the width and parallel to the first vertical length, the second vertical length being a distance from a top edge of the flange to a bottom edge of the flange, and wherein the second vertical length is less than the first vertical length by a third vertical length;

a second flange that extends substantially perpendicularly from the first flange at an end of the first flange that is opposite the support surface;

wherein:

the support member further comprises a third flange that extends substantially perpendicularly from the support surface and having a surface in a same plane of the first flange and on the same side of the support member as the first flange, the third flange being the third vertical length measured parallel to the first and second vertical lengths, and the third flange being a width measured parallel to the width of the first flange and that is less than the width of the first flange; and the first flange extends from a first portion of the support surface equal to the second vertical length, and the third flange extends from a second portion of the support surface equal to the third vertical length.

2. The support device of claim 1, further comprising a bracing component connected to the support member and that provides rigid support to the support member to reduce flexion of the support member.

3. The support device of claim 2, wherein the bracing component is a fourth flange extending substantially perpendicular from the third flange along the third vertical length.

4. The support device of claim 1, wherein the first flange includes a slot that is spaced apart from the second flange a distance that is equal to a distance of a stud track into which may be received a wall stud to which the support device can be mounted.

5. The support device of claim 4, wherein the width of the first flange as measured perpendicularly to the second vertical length is such that the support surface and the second flange are received within the wall stud when the support device is mounted to the wall stud.

* * * * *